US011482140B2

(12) United States Patent
Ghosh

(10) Patent No.: US 11,482,140 B2
(45) Date of Patent: Oct. 25, 2022

(54) DIGITAL LIGHT INDUCED ENTRANCEMENT (DILIET)

(71) Applicant: Ashim Ghosh, New Delhi (IN)

(72) Inventor: Ashim Ghosh, New Delhi (IN)

( * ) Notice: Subject to any disclaimer, the term of this patent is extended or adjusted under 35 U.S.C. 154(b) by 277 days.

(21) Appl. No.: 16/302,647

(22) PCT Filed: Apr. 13, 2017

(86) PCT No.: PCT/IB2017/052134

§ 371 (c)(1),
(2) Date: Nov. 18, 2018

(87) PCT Pub. No.: WO2017/199112

PCT Pub. Date: Nov. 23, 2017

(65) Prior Publication Data

US 2019/0130799 A1 May 2, 2019

(30) Foreign Application Priority Data

May 18, 2016 (IN) ..... 201611017153

(51) Int. Cl.
*G09F 19/12* (2006.01)
*H05B 47/155* (2020.01)
*G09F 13/00* (2006.01)

(52) U.S. Cl.
CPC ..... *G09F 19/12* (2013.01); *G09F 13/005* (2013.01); *H05B 47/155* (2020.01)

(58) Field of Classification Search
CPC .... B44F 1/08; B44F 1/10; F21S 10/02; G09F 19/20; G09F 19/12; G09F 13/005; H05B 47/155
See application file for complete search history.

(56) References Cited

U.S. PATENT DOCUMENTS 1,899,962 A * 3/1933 Higginbotham ..... G03C 11/14 430/15
1,930,359 A * 10/1933 Hilgenberg ..... G02B 6/0071 40/442

(Continued)

FOREIGN PATENT DOCUMENTS

WO 2008027174 3/2008

*Primary Examiner* — Cassandra Davis
(74) *Attorney, Agent, or Firm* — Mark M. Friedman

(57) ABSTRACT

The present invention relates to a method for the creation of dynamic artworks from static artworks; comprising of designing, fabrication, painting, creating & printing of artworks of a specific and precise calibrated colour and shade arrangement in the forms, images, shapes and backgrounds or the artworks, followed by illuminating these static artworks of diverse sizes, using specific lighting sequences and transitions of specifically calibrated colour ranges and shades; that dynamically transform the colours, luminosities and perception of forms, images, shapes and backgrounds in the static artworks, making them into dynamic animated artworks. The current invention enables the creation of a wide range of artistic, functional, precisely controllable, automatable, interactive and futuristic dynamic applications of said static Artworks, that include creation of applications in artistic exhibitions & installations, graphics, luminosities and perception of forms, shapes texts, illustrations, objects, building & architectural facades, etc.

4 Claims, 18 Drawing Sheets
(17 of 18 Drawing Sheet(s) Filed in Color)

(56) References Cited

U.S. PATENT DOCUMENTS

| | | | | |
|---|---|---|---|---|
| 2,020,087 | A * | 11/1935 | Berltreshansky | G09F 13/12 40/442 |
| 3,745,678 | A * | 7/1973 | Thomassen | G09F 19/12 40/442 |
| 4,703,572 | A * | 11/1987 | Chapin | G09F 13/42 250/461.1 |
| 5,003,715 | A * | 4/1991 | Steiner | G09F 13/04 40/427 |
| 7,038,398 | B1 | 5/2006 | Lys et al. | |
| 2008/0174660 | A1 * | 7/2008 | Noor | G09F 19/12 348/97 |

* cited by examiner

Pic#1(in white light)

Pic#2(in blue light)

Pic#3(in red light)

*(Swami ©2016MS Kaalia - based on the sketches of Dr.A.B.Ghosh, New Delhi)*

CS#1 – Daylight/White Light

CS#2 – Cyan Light

CS#3 – Magenta Light

CS#4 – Yellow light

CS#5 – Red Light

CS#6 – Blue Light

CS#1 in Daylight or White light

CS#2 in Blue Light

CS#3 in Cyan Light

CS#4 in Green Light

CS#5 in Magenta Light

CS#6 in Red Light

CS#7 in Yellow Light

CS#1

CS#2

CS#3

CS#4

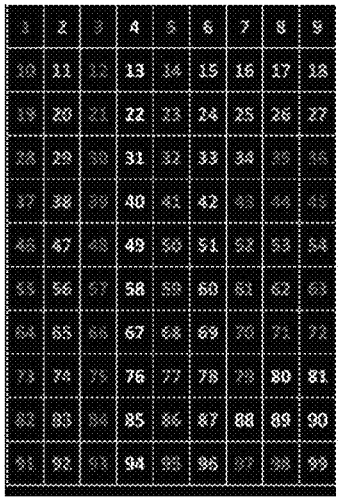

When lit with White Light, (R255, G255 and B255) all the numbers – 99/99 are clearly visible

Fig. 15(a)

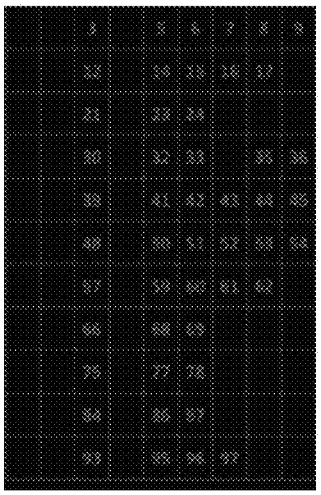

When lit with Blue light – B255 49/99 numbers are visible – the numbers coloured Blue (17), Cyan (16) and Magenta (16)

Fig. 15 (b)

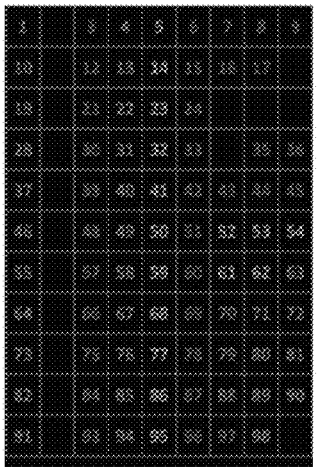

When lit with Magenta Light, (R255 and B255) 82/99 numbers are clearly visible –numbers coloured Red (17), Blue (17), Magenta (16) and Yellow (16)

Fig. 15 (c)

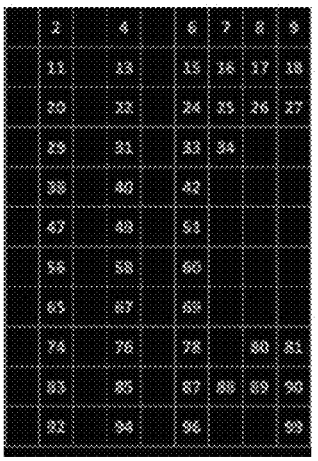

When lit with Green light – G255 – 49/99 numbers are visible – the numbers coloured Green (17), Cyan (16) and Yellow (16)

Fig. 15 (d)

When lit with Cyan Light, (G255 and B255) 82/99 numbers are clearly visible – numbers coloured Green (17), Blue (17), Cyan (16) and Yellow (16)

When lit with Red light – G255 49/99 numbers are visible – the numbers coloured Red (17), Yellow (16) and Magenta (16)

When lit with Yellow Light, (G255 and R255) 82/99 numbers are clearly visible – numbers coloured Green (17), Red (17), Magenta (16) and Yellow (16)

| | | | | | | | |
|---|---|---|---|---|---|---|---|
| **diliet Colours** | | | | | | | |
| **8 bit RGB calibration for diliet colours for Artworks & Lighting** | | | | | | | |
| | | | **R** | **G** | **B** | Total# of shades | |
| **diliet Artworks** - *diliet colours to be used in specific combinations Juxtapositions of Components on specific backgrounds* | | Blue | | | 256 | *256* | B255-0(Black) |
| | | Cyan Grp* | | 256 | 256 | *65536* | B&G255-0(Black) |
| | | Green | | 256 | | *256* | G255-0(Black) |
| | | Yellow Grp* | 256 | 256 | | *65536* | R&G255-0(Black) |
| | | Red | 256 | | | *256* | R255-0(Black) |
| | | Magenta Grp* | 256 | | 256 | *65536* | R&B255-0(Black) |
| **diliet Lighting** - *diliet colours to be used in specific sequences, choice, order & duration of light colours, and the transitions between light colours* | | **B&W** | | | | *256* | RGB255(White)-0(Black) |
| | | *Deduct 6 Blacks counted earlier* | | | | *-6* | RBGCYM-0(Black) |
| | | **Number of diliet colours** | | | | **131834** | **0.79%** of all RGB colours |
| | | **Add ~10% colours dark enough to look black** | | | | | **10%** |
| | | **Total Colours RGB - 256^3** | | | | **16777216** | |
| | | **Number of non-diliet colours** | | | | **16645382** | **~90%** of all RGB colours |
| | | **All possible combinations of the 256 shades of the 2 Primary colours in the Group (reference for convenient Grouping only)* | | | | | |

Fig. 16

DIGITAL LIGHT INDUCED ENTRANCEMENT (DILIET)

This application is a U.S. national phase application, pursuant to 35 U.S.C. § 371, of PCT/IB2017/052134, filed Apr. 13, 2017, designating the United States, which claims priority to Republic of India Application No. IN201611017153, filed May 18, 2016.

FIELD OF THE INVENTION

The present invention relates to a method for the creation of dynamic artworks from static artworks; comprising of designing, fabrication, painting, creating & printing of artworks of a specific and precise calibrated colour and shade arrangement in the forms, images, shapes and backgrounds or the artworks, followed by illuminating these static artworks of diverse sizes, using specific lighting sequences and transitions of specifically calibrated colour ranges and shades; that dynamically transform the colours, luminosities and perception of forms, images, shapes and backgrounds in the static artworks, making them into dynamic animated artworks.

BACKGROUND OF THE INVENTION

All materials have pigments which absorb or reflect light, and determine the colour of the material when lit up. Materials with White pigments reflect back light of all colours. So, if the light is White, the material looks White. But if the light is red, the material looks Red, since there is no other colour in the light to reflect back, and so on.

Materials with Black pigments, absorb light of all colours, and reflect back none. So, when light of any colour is shone on materials with black pigments, the material absorbs all the light reflecting back none, and looks Black.

Similarly, materials with Red pigments, reflect back only Red light, and absorb light of all other colours. So, such Red materials look Red in White light; since White light contains Red light which is reflected back, and the Blue & Green light contained in White light is absorbed and not reflected. With the same logic, materials with Red pigments look Black when lit with any light that does not contain Red light, since the material has no Red light to reflect back, and absorbs the light of all other colours. This is the same with materials with Blue of Green pigments.

Based on this principle, materials with Yellow pigments, look yellow in the presence of White light, or Yellow light (a mix of Red and Green lights) since it reflects back all Red & Green light, but absorbs all Blue light. So, when Yellow material is lit with Red light it looks Red, since there is no Green light to reflect back. When lit with Green light it looks green, since there is no Red light to reflect back. When lit with Blue light, Yellow material looks black, since it absorbs all the Blue light and has no Red or Blue light to reflect back. When lit with Magenta light; a mix of Red & Blue light; Yellow material looks Red, since it absorbs the Blue light and reflects back the Red. So, on and so forth with different mixes of Red, Blue, Green, Magenta, Cyan and Yellow light. The problem is that most colours (about 90%+) contain all three primary colours—Red, Blue and Green) and never quite get dark enough to disappear. So, everything looks blue when lit with blue, everything looks yellow when lit with yellow. and so on . . . . Because of this, no effective industrial application has been devised, that can use this phenomenon effectively and usefully.

diliet has taken this scientific phenomenon and developed a technical process that can create specifically coloured static Artworks—Graphics, forms, shapes, texts, illustrations, objects, etc. that when lit up with a specifically choreographed RGB lighting transform their colours, and results in a spectacular synchronous animation of the different elements—artwork and lighting and the lighting inter-transformation(time taken by one coloured light to transform into to another—zero milliseconds onwards).

These diliet graphic elements appear (visible since coloured), disappear (not visible since they turn black or merge into the background colour) or change colour (as described above), depending on the colour(s) of the light that are shone on them, and the background they are against.

Current Practice of Dynamic Artworks:

Static Artworks are of diverse types, from Paintings and Calligraphy to Graphics, Photographs and Commercial billboards, of hugely diverse sizes, from Exhibition prints in Galleries with focused lighting, to huge billboards lit up with outdoor lighting and a diverse range of 3D objects from Buildings to Automobiles. Static Artworks are lit up in several ways. Dynamic Artworks are created using diverse technologies from Cinema and Video to 3D Animation. Dynamic Artworks are presented on Television, Video Projections, Flashing Neon Signs, or LCD Screens of different shapes and sizes, which also are their own light source, and do not need any extra Lighting. These too can be scaled up; at great expense; like we see in the image of Trafalgar Square, London, as depicted in FIG. 1.

Drawbacks in Current Practice of Dynamic Artworks:

As mentioned earlier, Dynamic Artworks are presented on Television, Video Projections, Flashing Neon Signs, or LCD Screens of different shapes and sizes The Big Disadvantage of this is that:

- The expense involved in both creation, execution and display are huge.
- When it comes to the huge LCD Screens used for outdoor displays, not only are they expensive, that are environmentally unfriendly, generate a lot of heat, consume lots of energy and also add to the huge piles of harmful electronic components collecting in junk yards.
- However Normal static Artworks can be lit up by sequences of coloured light, but the end result has no impact, since the Artwork was not created specially and specifically to respond to the effect of specific coloured lighting on the colours of the Artwork.

Currently there is no technique which facilitates the creation of Dynamic Artworks from specific Static Artworks simply using lighting sequences of coloured lighting. In FIG. 2 such an illustration is depicted wherein the same artwork is exposed to different coloured lights and consequently looks the same colour state (CS) as the light.

CS #1—Daylight—All colours visible
CS #2—Green light—All look Green
CS #3—Cyan Light—All look Cyan
CS #4—Red Light—All look Red
CS #5—Magenta Light—All look Magenta
CS #6—Yellow Light—All look Yellow

SUMMARY OF THE INVENTION

Prime object of the invention is to propose a novel technology or method which facilitates the creation of Dynamic Artworks (two dimensional or three dimensional) from specific Static Artworks by simply using lighting sequences of coloured lighting. The proposed method, due to application of specific and calibrated light on to a static artwork of specific colour arrangement therein modifies the said artwork in such a manner that it seems to be dynamic or extraordinarily improved in terms of final colour, pattern, look, luminosities and perception of forms, and visible impressions to human eyes.

Another object of the invention is to propose method of creating specifically coloured printed and/or fabricated and/or painted static Artworks—Graphics, forms, shapes, texts, illustrations, objects, etc.; wherein such static artworks are characterized in a spectacular synchronous animation or dynamic artwork(s) of the different elements—graphic and lighting, once the said Artworks are lit up with specifically choreographed RGB lighting that results in a specific transformation of their colours, luminosities and perception of forms.

Another object of the invention is to proposed diliet technique, comprising of mainly two stages, as under:

Stage (1)—designing and printing and/or fabricating and/or painting the static diliet Artwork (two dimensional or three dimensional)—depending on Artistic thoughts and ideas or catering to an Advertising or Manufacturing brief about a commercial product, the Artwork gets created and/or manufactured. The main uniqueness of the artwork is that it uses specifically calibrated colours and shades, in the shapes, forms, text, etc. used, that will predictably transform into certain colours, depending on the colours of the lighting and their inter-transformation (time taken by one coloured light to transform into to another—zero milliseconds onwards).

Stage 2—Lighting the Artworks—once the static Artworks have been created, specially calibrated coloured lights are programmed into a sequence. The specific Calibration of the lights depends on the specific calibrated colours used in the Artworks (two dimensional or three dimensional), as well as on the desired colour transformation effect. The diliet lighting sequence transforms the diliet static Artwork into a dynamic Artwork.

Another object of the invention is to propose a technique to bring out two colour phenomenon together by applying calibrated coloured lights or sequence of such calibrated coloured lights on to static Artwork (two dimensional or three dimensional), comprising of specifically calibrated colours used in the said Artwork, leading to transformation of said static artwork into a novel, specific and differently coloured artwork that demonstrate a unique dynamic transformation behaviour; wherein said dynamic transformation behaviour of the artwork is specific, predictable and programmable in the presence of specific lighting sequences; and wherein calibrated coloured light (or coloured light sequence) applied on said static artwork is so chosen that it is compatible to and depends on the calibrated colour(s) used in the said static Artwork.

Another object of the invention is to propose the primary use of specific calibrated colours and shades in artworks (two dimensional) & objects (three dimensional); which do not contain one or two Primary colours; juxtaposed in ways that lead to a specific and predictable behaviour of changing colour, luminosities and perception of forms, when lit by specific sequences of coloured light.

Another object of the invention is to propose diverse dynamic applications from artistic exhibitions & installations and dynamic billboards advertising, to signage, performance, theatre, cinema, events, interior decor, exterior decor, furnishings, clothes, cutlery, etc.

Another object of the invention is to propose the uniqueness with which static artworks and objects are physically transformed to dynamic artworks and objects just by simple lighting sequences, whereby the components change colours dramatically, and appear and disappear in simulated movement, earlier only seen on video or graphic animation.

digital light induced entrancement (diliet) is a unique invention that combines available Art practices and lighting technologies, to create specially designed Static Artworks that transform into Dynamic Artworks when light up in specific sequences of specially calibrated lighting. This is shown in FIG. 3—how a diliet artwork transforms into 4 colour states (CS) with 4 different lighting colours.

CS #1—White Light (R255 G255 B255)

CS #2—Lighting colour A

CS #3—Lighting colour B

CS #4—Lighting colour C

The proposed diliet technique is a technical process that can create specifically coloured printed and/or fabricated and/or painted static Artworks—Graphics, forms, shapes, texts, illustrations, objects, etc. that when lit up with a specifically choreographed RGB lighting transform their colours, and results in a spectacular synchronous animation of the different elements—graphic and lighting.

Present Diliet Technique has Mainly Two Stages:

Stage 1—designing and printing and/or fabricating and/or painting the static diliet Artwork—depending on Artistic thoughts and ideas or catering to an Advertising brief about a commercial product, the Artwork gets created. The main uniqueness of the artwork is that it uses specifically calibrated colours and shades, in the shapes, forms, text, etc. used, that will predictably turn into certain colours, depending on the colours and inter-transformations of the lighting.

Stage 2—Lighting the Artworks—once the static Artworks have been created, specially calibrated coloured lights are programmed into a sequence. The specific Calibration and inter-transformations of the lights depends on the specific calibrated colours used in the Artworks, as well as on the desired colour transformation effect. The diliet lighting sequence transforms the diliet static Artwork into a dynamic Artwork.

diliet artworks and objects are distinctive and unique, in that their elements; forms, shapes, text, backgrounds, etc.; are coloured with specific colour ranges and shades (Shade: a colour made darker by adding black), specifically juxtaposed to change colour and form when lit by a specific sequence of calibrated coloured lighting. 7 main colours and their shades; from full saturation (255) to zero saturation (black); are primarily used in diliet Artworks & Objects. White, Red, Green, Blue, Yellow, Magenta and Cyan (Black is any of these colours at zero saturation). Other than that, diverse combinations of any two Primary Colours (Red, Green & Blue) are also used. Colours which are formed with combinations of all three Primary colours (except the range of White to Black) are rarely featured. So, Colours and colour shades primarily used in diliet Artworks and objects, consist of colours which are formed by either only one Primary colour or a mix of two Primary Colours. The reason for this is what makes a diliet Artwork or object unique.

Similarly for lighting (in RGB 8 bit), 7 main colours and their shades; from full saturation (255) to zero saturation (black); are primarily used in diliet. White, Red, Green, Blue, Yellow, Magenta and Cyan (Black is any of these colours at zero saturation). Other than that, diverse combinations of any two Primary colours (Red, Green & Blue) are also used. As the saturation of these coloured lights are reduced, their colour effect is also reduced.

Say a diliet Artwork contains components in 6 primary diliet colours; Red, Green, Blue, Yellow, Magenta & Cyan; on a black background. Since the components of the diliet artwork or object is coloured with colours that do not contain one or two primary colours, when the diliet object is lit by that missing colour; say Red (at 255), the components coloured with colours that do not contain Red; Cyan, Blue, Green and their shades; will dramatically turn dark; completely or partially disappearing into the black background, while the components coloured with colours that have Red; Red, Yellow, Magenta, and their shades; will turn shine out in Red (and will be dark or bright red depending on the shade of red in the component).

If the Object is now lit with Green (at 255) light, then the components coloured with colours that do not contain Green; Red, Blue, Magenta and their shades; will dramatically turn dark, completely or partially disappearing into the black background, while the components coloured with colours that have Green; Green, Yellow, Cyan, and their shades; will turn shine out in Green (and will be dark or bright Green depending on the shade of green in the component).

If the Object is now lit with Yellow light (combination of Red 255 and Green 255 light), then the components coloured with colours that do not contain Red or Green; Blue and its shades; will dramatically turn dark, completely or partially disappearing into the black background. The components coloured with colours that contain Green but no Red; Green and Cyan and their shades; will dramatically turn green. The components coloured with colours that have Red but no Green; Red and Magenta and their shades; will dramatically turn Red. While the components coloured Yellow will turn shine out in Yellow (and will be dark or bright yellow depending on the shade of yellow in the component).

Now imagine this diliet Artwork lit by a sequence of 1 second each of Red, Green and Yellow light, cutting to each other on a loop. The 3 dramatic phenomena described above; colours, components and perception transforming and appearing and disappearing; will now repeat in a sequence of 1 second, each phenomena cutting to the next, in a continuous loop. This is the dynamic essence of diliet.

If the lighting sequence introduces simple dissolve transitions between the lights; so, the jerk of the light cutting to each other is smoothened; the above three phenomena take on a further magic, as the inter-transition time (zero milliseconds onwards) of the light and frequency changes plays further with the perception of our sight, and components transform dramatically. And because components appear and disappear as the light colour change, the dynamic behaviour induced by diliet also demonstrates a unique simulation of movement and animation.

So if the said diliet Artwork is lit by a sequence of 1 second each of Red, Green and Yellow light, transforming to each other in a time of 2 seconds, on a loop, the 3 dramatic phenomena, namely colours, components and perception changing, appearing and disappearing, will get repeated in a sequence of 3 seconds, each phenomena static for 1 second then smoothly transforming to the next, in a continuous loop and thus realizing a different and customizable dynamic colour transformation effect in a unique simulation of movement and animation.

Additionally, using the diliet technique of specifically calibrating colours and printing/fabricating artworks and objects, the Primary and Secondary colours represented in maximum saturation, glow with a unique luminous glow when lit by that colour, seen before only with fluorescent materials and paints exposed to Ultraviolet light, and never seen before otherwise. The phenomena simulates Wave theory, when similar/same wavelengths get strengthened (increased amplitude) when they meet.

The diliet phenomena works best in darkened spaces, where the ambient light is quite low.

To understand the diliet technique, it is important to understand Additive Colours for precise diliet Artwork creation as well as for diliet Lighting. In Lighting, Red, Blue and Green are Primary Colours—RGB. Using computers and other digital equipment, Red, Blue and Green Light can be mixed with each other with values from 0 to 255, giving 256 shades of each colour, going from pure Black (0) to pure R, G or B (255) and the shades within. Red, Blue & Green lights with values of 255 are pure Primary colours, which when mixed together at that value, create White light. Red, Blue & Green lights with values of 0 when mixed together at that value, create an absence of light, which results in experiencing Black. Red, Blue and Green Light mixed with each other with values of 255; but two at a time; create Secondary colours—Magenta, Cyan and Yellow.

TABLE 1

Various combinations of the three colours lead to 256 × 256 × 256 possible colours of light--~1.67 million colours

| Primary Light colour | Red light | Blue light | Green light | Resulting Light Colour |
|---|---|---|---|---|
| Value | 255 | 255 | 255 | White |
| Value | 0 | 0 | 0 | No Light-Black |
| Value | 255 | 255 | | Magenta(secondary) |
| Value | | 255 | 255 | Cyan(secondary) |
| Value | 255 | | 255 | Yellow(secondary) |

In the descriptions below, all references to Red, Blue, Green, Magenta, Cyan and Yellow refer to their pure light forms as mentioned above.

Technical Features of Diliet:

(a) Creating and Printing the Static diliet Artwork i) Artworks need to be created in the RGB mode and not in CMYK mode in ii) Colours to be used are—White, Black, Red, Blue, Green, Magenta, Cyan and Yellow, and their various shades (from the colour to Black)

TABLE 2

Variation of original colour to Black

| RGB Primary colour | Red | Blue | Green | Resulting Colour |
|---|---|---|---|---|
| Value | 255 | 255 | 255 | White (no printing-paper colour) |
| Value | 0 | 0 | 0 | Black |
| Value | 255 | 255 | | Magenta |
| Value | | 255 | 255 | Cyan |
| Value | 255 | | 255 | Yellow |

iii) Text and Shapes/Forms etc, will appear or disappear depending on the subtlety or obviousness of their colour difference, and how they responds to the colour of the light.

iv) Simpler shapes; not photographic, with many tones and details; are preferred v) Shapes in different colours will simulate dynamism vi) Concentric circles or shapes in different colours will simulate movement vii) Calibrate your Computer monitor to the specific printer to show accurate colours, especially when calibrating a diliet print for CMYK printing.

viii) When re-calibrating RGB values to CMYK care and precision needs to be taken to ensure the best possible and closest RGB representation.

ix) Always do a test print or colour analysis to check the accuracy of your colours with proper calibration meters.

(b) Lighting the Static diliet Artwork i) RGB lights with precise programmable lighting controllers must be used.

ii) Using controllers, different combinations of RGB can be used and lighting sequences can be programmed.

iii) Depending on how (the effect of transition—dissolve, cut, wipe) and when (after how long—inter-transformation time) the lights change will start the dynamism in the static diliet Artwork.

iv)

TABLE 3

List of the effect of coloured light on Artwork Colours:

| | Colour of Artwork → | | | | | | |
|---|---|---|---|---|---|---|---|
| + Colour of Light ↓ | W | R | B | G | M | C | Y |
| White—W | W | R | B | G | M | C | Y |
| Red—R | R | R | BL | BL | R | BL | R |
| Blue—B | B | BL | B | BL | B | B | BL |
| Green —G | G | BL | BL | G | BL | G | G |
| Magenta—M | M | R | B | BL | M | B | R |
| Cyan—C | C | BL | B | G | B | C | G |
| Yellow—Y | Y | R | BL | G | R | G | Y |

The Static diliet Artwork thus has to have a specific synchronicity of colour calibration and use, with the calibrated diliet Lighting sequence.

(c) Advantages of diliet—digital light induced entrancement:

(i) Seeing diliet Static Artworks transform into diliet Dynamic Artworks is spectacular and magical (ii) diliet Dynamic Artworks are a High quality, High Tech, and Low-Cost alternative to the prevalent systems of Creating and presenting dynamic Artworks (iii) diliet uses minimal technology overall, and is vastly more Eco and Environmentally friendly that the prevalent Technologies for Dynamic Artwork creation and presentation Since such precise combinations and sequences of precisely coloured lights do not occur naturally, all specific diliet coloured Lighting sequence have to be created digitally; either using computers, or special Mixers that record and playback lighting sequences, typically using a DMX protocol, by which lights can be sequenced and played back on loops, in accurate colours, timing and transitions.

There are many colour mixing software; both for creating & designing Artworks & objects, and for mixing and creating specific lighting sequences. For the first time, diliet brings the two colour phenomenon together, to create specific artworks that demonstrate a unique dynamic transformation behaviour; specific, predictable and programmable; in the presence of specific lighting sequences. It's like there are millions of kinds of human movements, and millions of kinds of sounds. But a specific proprietary "musical dance-form" is invented only when the following happens. From the millions of possible sounds, specific sounds, rhythms, frequencies, timbres, volumes, etc. are choreographed, juxtaposed and composed into a specific collection of sounds, which can perhaps now be called music, but can certainly be called unique. Simultaneously; from the millions of human movements, specific unique movements at specific times by specific dancers (components) are choreographed, juxtaposed and composed into a specific unique collection of movements, that when synched to the specific unique music created, can now be called a unique "musical dance form".

Diliet precisely juxtaposes specific static components in specific calibrations of colours and their shades, in a way that will predictably result in a specific unique and dynamic behaviour, when lit up by specific sequences of coloured lighting.

BRIEF DESCRIPTION OF THE DRAWINGS

The patent or application file contains at least one drawing executed in color. Copies of this patent or patent application with color drawing(s) will be provided by the Office upon request and payment of the necesaary fee.

Some embodiments of the present invention are herein described, by way of example only, with reference to the accompanying drawings. With specific reference to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

Attention is now directed to the drawings, where like reference numerals or characters indicate corresponding or like components. In the drawings:

FIG. 1 is an image of Trafalgar Square, London;

FIG. 2 is an illustration of the same artwork exposed to different coloured lights;

FIG. 3 is an illustration of a diliet artwork transforming into 4 colour states (CS) with 4 different lighting colours;

FIG. 4 is an illustration of a static diliet artwork responding to specific lighting;

FIG. 5 is an illustration of another static diliet artwork responding to specific lighting;

FIG. 6 is an illustration a static diliet artwork, which includes text, responding to specific lighting;

FIG. 7 is an illustration an outdoor billboard design or wall painting responding to specific lighting;

Figure 8A:
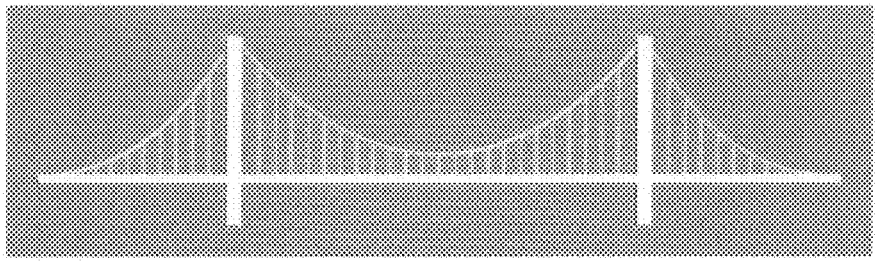
Figure 8B:
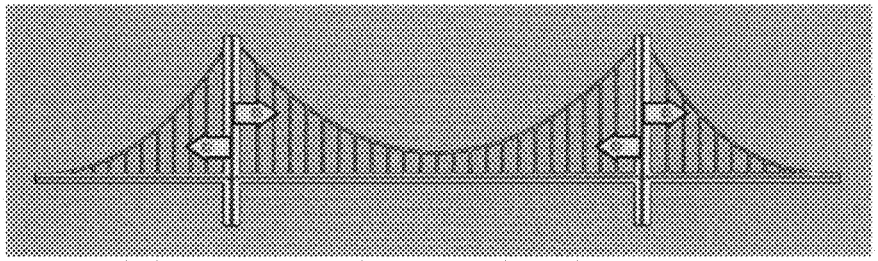
Figure 8C:
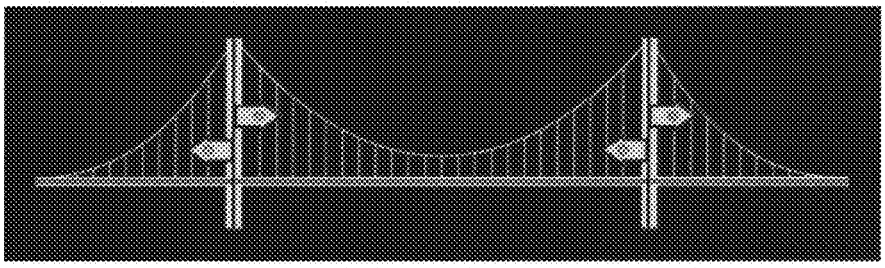
Figure 9A:
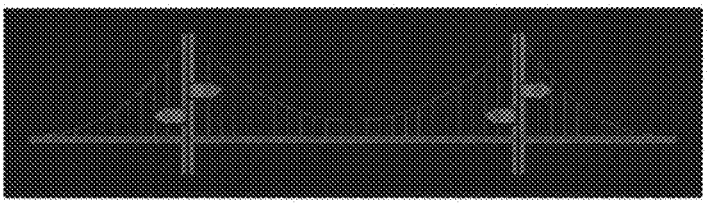
Figure 9B:
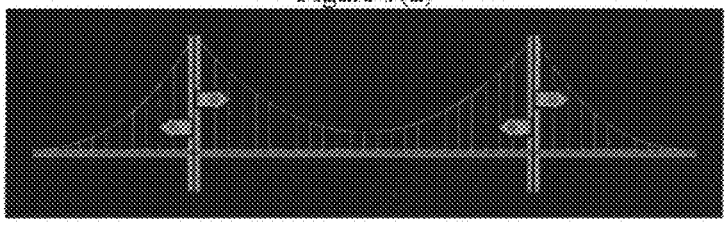
Figure 9C:
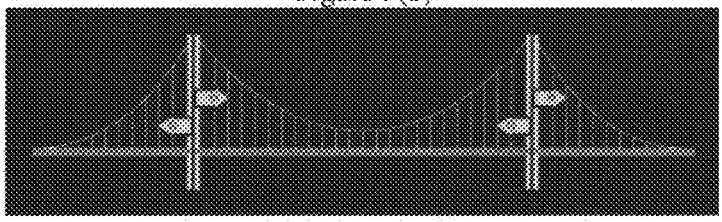
Figure 9D:
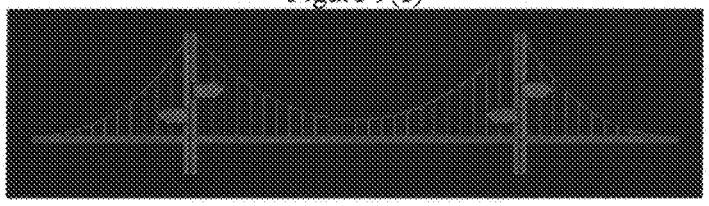
Figure 9E:
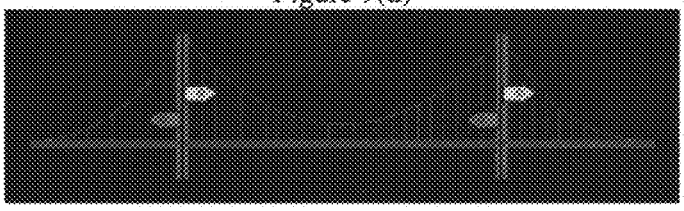
Figure 9F:
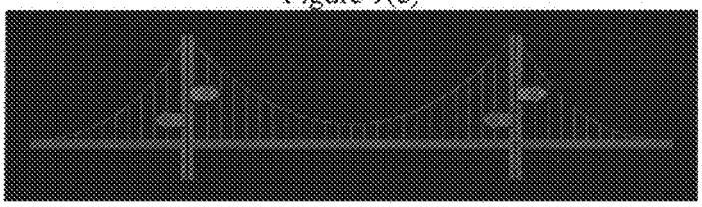
Figure 10:
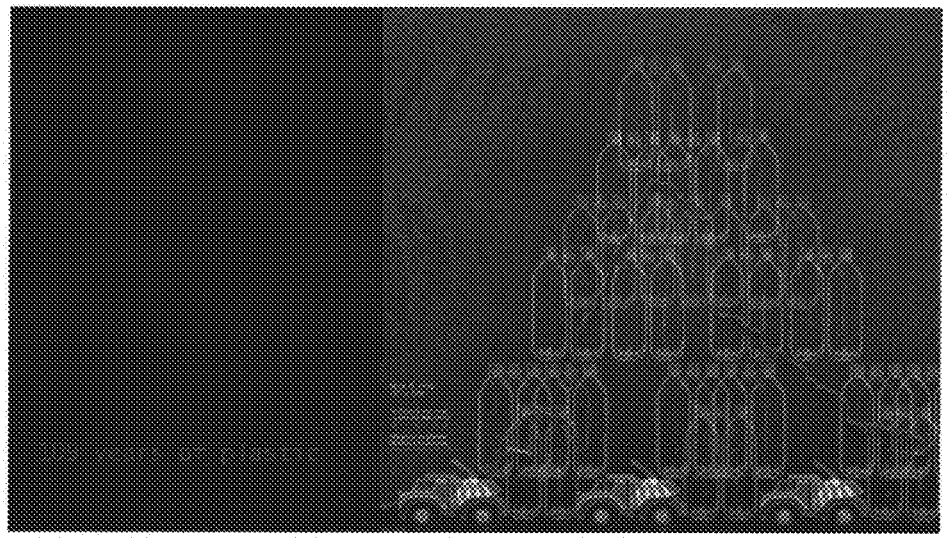
Figure 10:
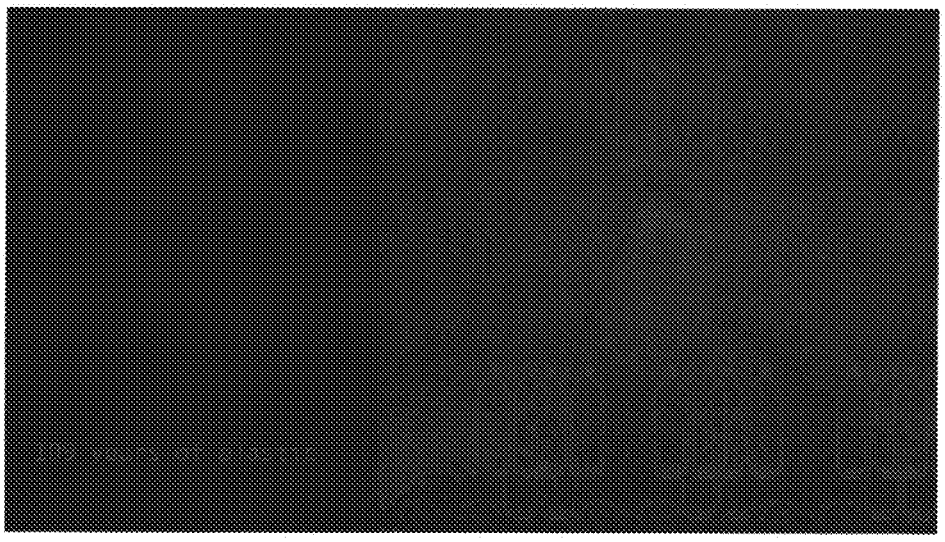
Figure 10:
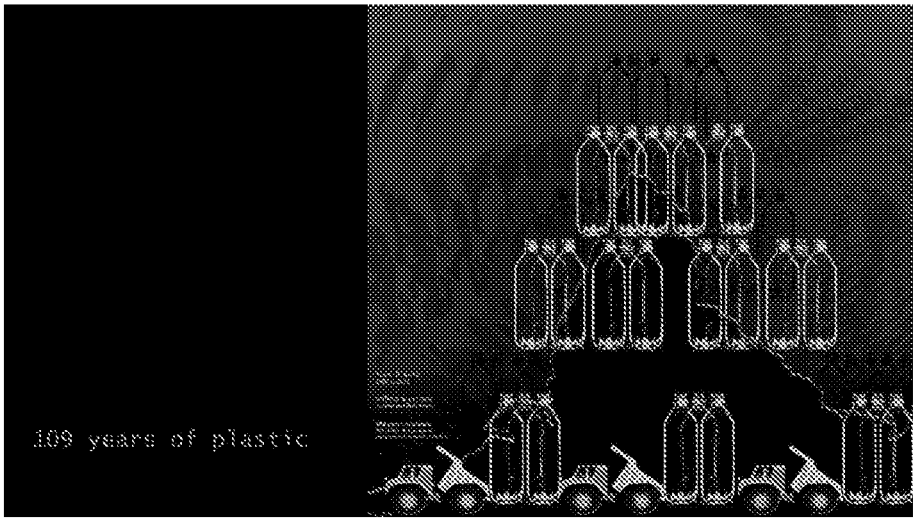
Figure 10:
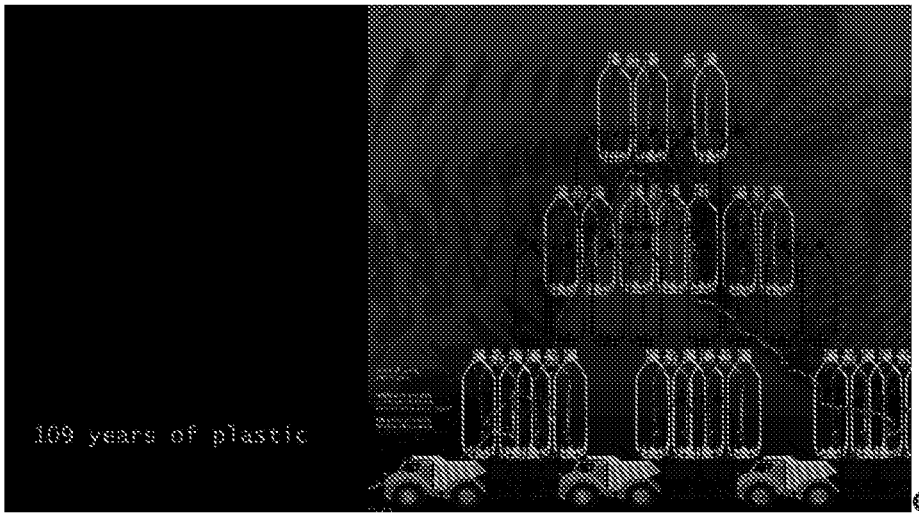
Figure 14:
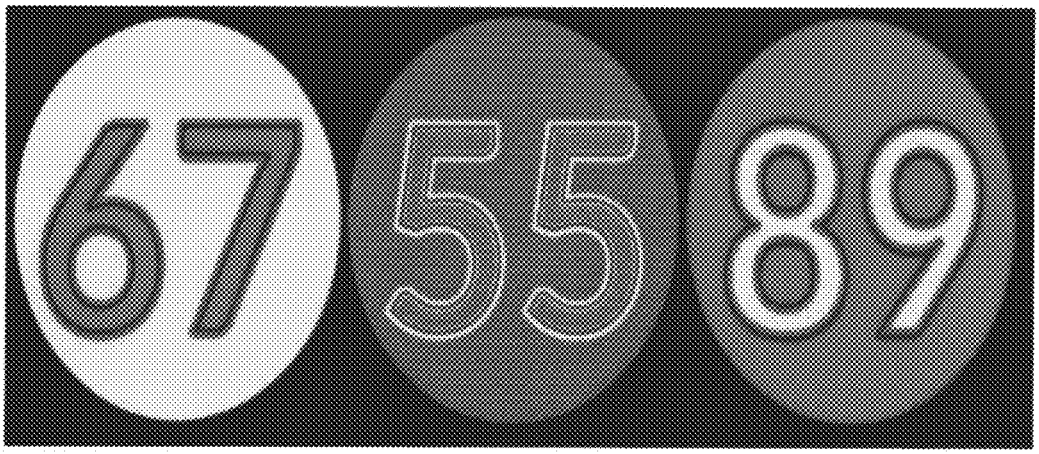
Figure 15:
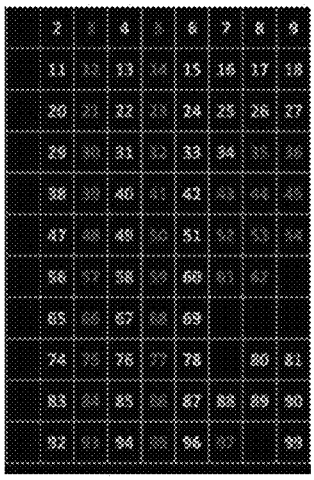
Figure 15:
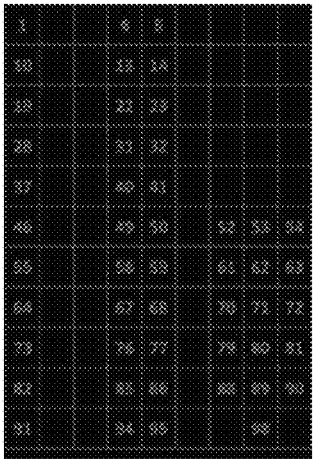
Figure 15:
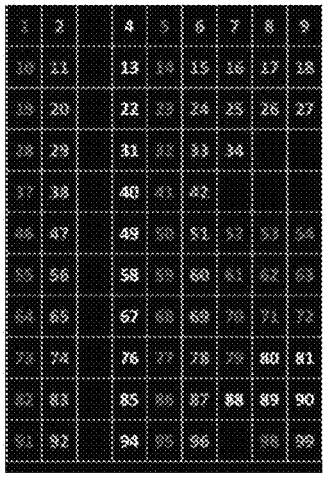

FIGS. 8*a*-8*c* are illustrations of a static diliet artwork placed on a bridge, responding to specific lighting;

FIGS. 9*a*-9*f* are illustrations of a static diliet artwork placed on a bridge, changing its lighting in response traffic density;

FIG. 10 is an illustration of a static diliet artwork crafted for an exhibition on issues of "sustainable development" at the India Habitat Centre, New Delhi;

FIGS. 11*a*-11*e* are illustrations of the effect of diliet lighting sequences on coloured strips;

FIGS. 12*a*-12*c* are illustrations of the effect of diliet colour lights on a yellow Fluorescent strip against the Charcoal Black Background;

FIGS. 13*a*-13*f* are illustrations of the effect of diliet lighting sequences on a runway including a static diliet artwork;

FIG. 14 is an illustration of three balls each including a number with two colour outlines, and a background colour.

FIGS. 15*a*-15*g* are illustrations of a board numbered 1-99 with a black background showing the visibility of the numbers when lit with different colours.

FIG. 16 is a table showing the 8 bit RGB calibration for diliet colours for Artworks and Lighting.

DETAILED DESCRIPTION OF THE INVENTION

The present disclosure is about a precise technical process of designing, creating and fabricating/printing Static Artworks of diverse sizes, using specifically calibrated colour ranges and shades, luminosities and perception of forms, images shapes and backgrounds in the Artwork. The Static Artworks need to be designed in a precision environment; say on a computer; where the colours and shades to be used in the Artwork can be set precisely. Based on the choice of specifically calibrated colours in the Artwork, precise lighting can be designed, with specifically calibrated and choreographed coloured lighting, which will affect and change the colours in the Artwork in spectacular ways, and transform the Static Artwork into a Dynamic Artwork.

For example in a diliet Artwork, a specifically coloured Green Text, on a specifically coloured blue background, can be designed to transform into darkness from green, when lit with a specifically coloured light, while the blue background remains blue. When the diliet technique is implemented in artistic and creative ways, incorporating different shapes, luminosities and perception of forms, colours and backgrounds into static artworks, specifically designed to interact with choreographed lighting design using sequences of specifically coloured diliet lighting, the static diliet Artworks transforms into a dynamic Artwork, and looks like it is performing to the lighting, as shapes and forms change colour, or disappear when they turn black or merge with the colour of the background, in a spectacular dynamic animation. diliet is designed to work in dark or light tight spaces, where the light falling on the diliet Artwork can be precisely controlled.

Light is easily and commonly calibrated using available technologies. There are three primary light colours, Red, Green and Blue. 8 bit colour (still the most common) divides each colour into 256 shades from full saturation—255, to zero saturation (black). When all three—RGB, are combined at full saturation (255) it results in White colour or light. When all three are at zero saturation, there is no colour or light. i.e. Darkness or Black. All other colours and coloured lights are formed by different combinations(255-0) of R, G & B. ($256^3$=~16 million colours) Using the commonly available Digital Multiplexing protocols and codes(DMX), and controllers, LED RGB lights can be controlled precisely, and commands regarding the colour of the light(RGB values 255-0), the duration of the light(in multiples of fractions of seconds) and the kind of transition between light changes (cut or dissolve for a specific duration). Precise Lighting sequences are thus written in coded instructions that control the lights through DMX, and can looped or repeated endlessly.

diliet artworks or objects can be specifically created to respond to a specific lighting sequence towards a specific effect, and vice-versa. Certain indicative illustrations to depict and explain the creation of diliet effect on specific diliet artwork are demonstrated hereinbelow with the help of different kind of embodiments of diliet artworks. Applications of such illustrations will definitely be the subject of commercial/industrial applications and therefore such commercial/industrial applications derived from such illustrations hereinbelow are within the scope of instant invention and are duly covered under the instant description.

Figure 1:
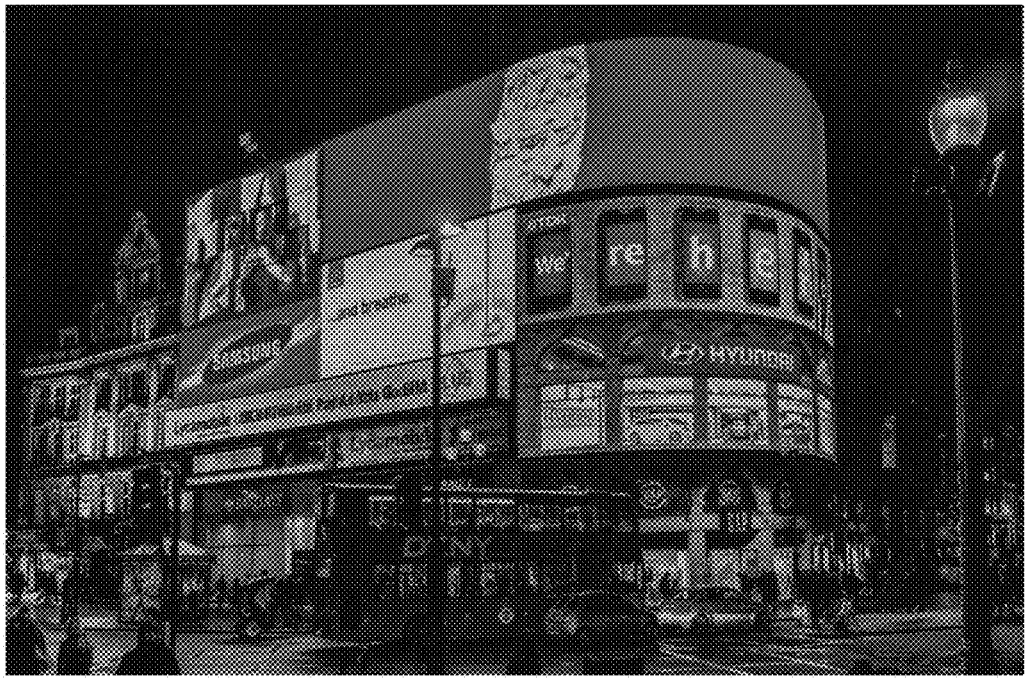
Figure 2:
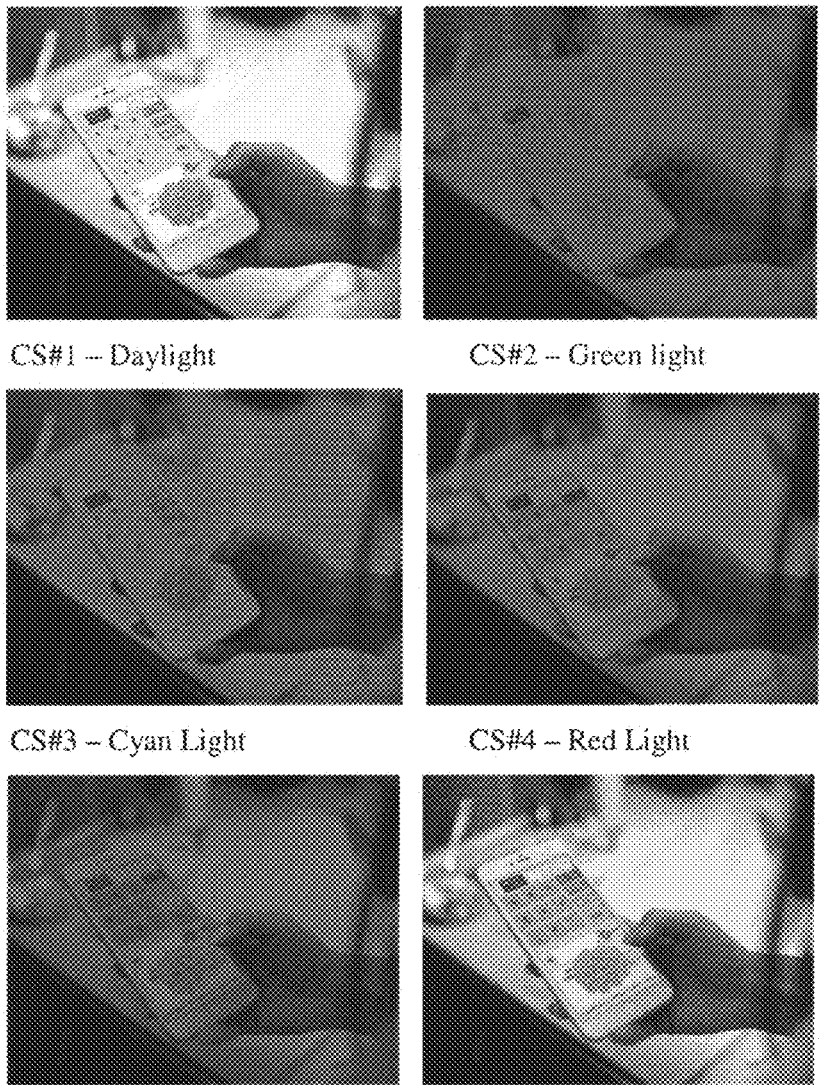
Figure 3:
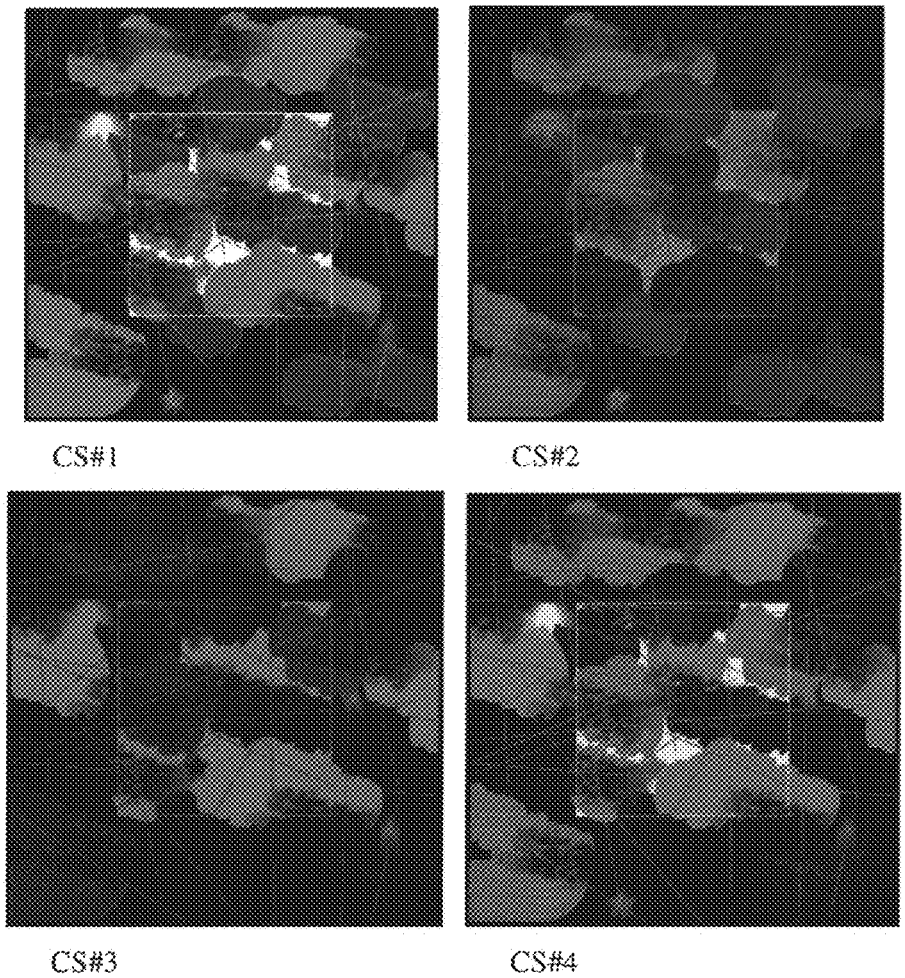
Figure 4:
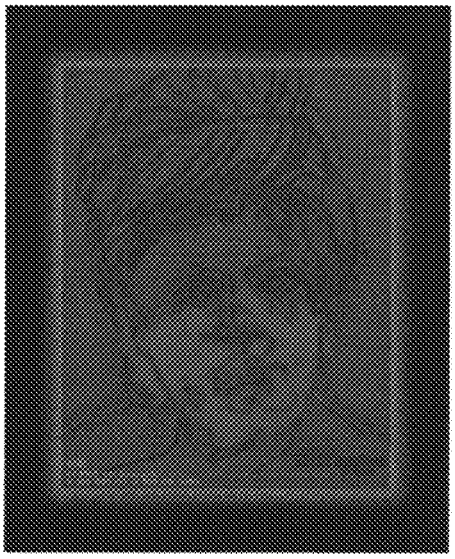
Figure 4:
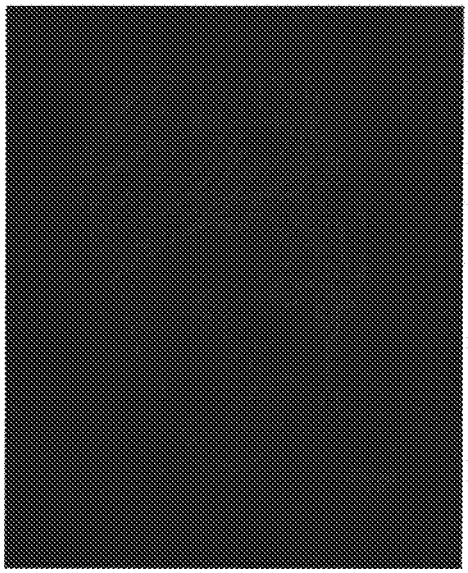
Figure 4:
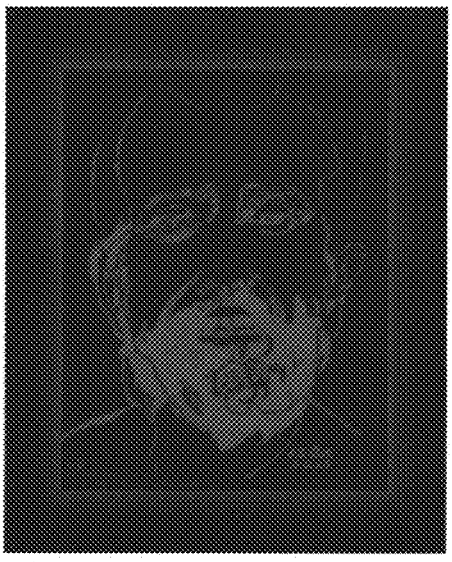

Example #1: Referring to the FIG. 4 hereinbelow, in the static diliet Artwork—Swami ©2016M.S.Kaalia, the sketch of Swami Ramkrishna Paramhansa is in Red, while the sketch of Swami Vivekananda is in Blue, both overlapped on a Green Background. The specific lighting sequence is alternating Red (255) & Blue (255) Light. The static Artwork in white light or daylight looks like Pic #1. When placed in a dark room and lit by the diliet lighting sequence (R/B), the Green background turns dramatically dark, and each Swami shines out one at a time, alternating between Pic 2 & 3. Where the yellow shaded boundary shines red in Red light, it turns black in Blue light. Thus, a static artwork Pic #1 of Drawing 4, transforms into dynamic "Colour States", as it is lit in by a specific diliet lighting sequence, as illustrated in Pic #2 and Pic #3 therein.

Example #2: This diliet artwork responds to specific lighting (given the artwork is lit in darkness or low ambient light), as explained herein with the help of FIG. 5 in the dramatic ways, or "Colour State/s"—CS.

CS #1 in Day light or White light (R255 G255 B255)—all the colours are visible—Red, Blue, Green, Yellow, Cyan, Magenta, White, Black;

CS #2 in Green Light (G255)—the Blue, Red and Magenta colours turn Black, while Yellow, Cyan and White turn Green CS #3 in Cyan Light (G255 B255)—The Red colours turn Black, Yellow turns Green, Cyan stays Cyan, Blue stays Blue, Green stays Green, Magenta turns Blue, and White turns Cyan CS #4 in Red Light (R255)—The Green, Blue and Cyan colours turn Black, Yellow turns Red, Magenta turns Red, and White turns Red CS #5 in Yellow Light (R255 G255)—The Blue colours turn Black, Yellow stays Yellow, Green stays Green, Red stays Red, Magenta turns Red, Cyan turns Green and White turns Yellow.

Figure 5:
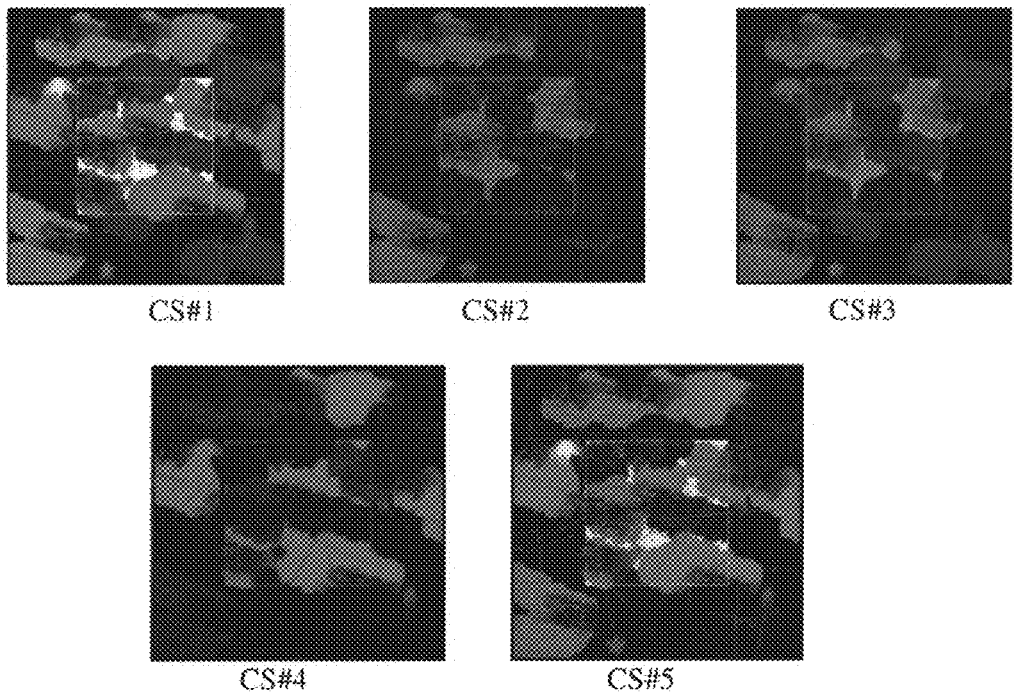

The diliet dynamism, as per Example 2 herein and the corresponding FIG. 5, gets even more enhanced when each colour state transitions from one to the other over time—quickly, slowly or immediately—in different orders, each combination leading to a different visual experience.

Figure 6:
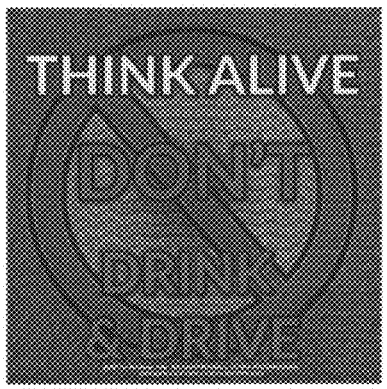
Figure 6:
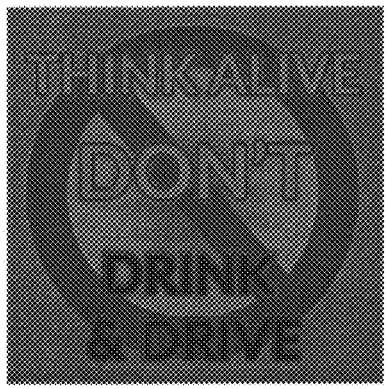
Figure 6:
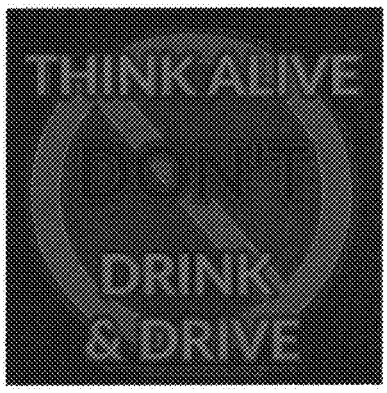
Figure 6:
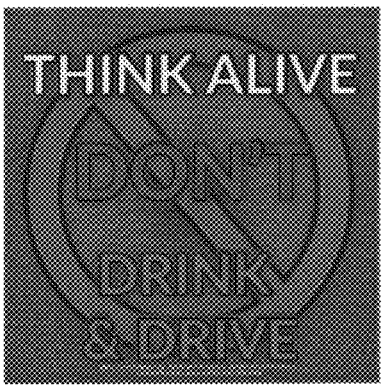
Figure 6:
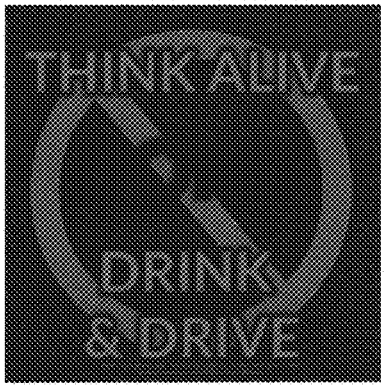
Figure 6:
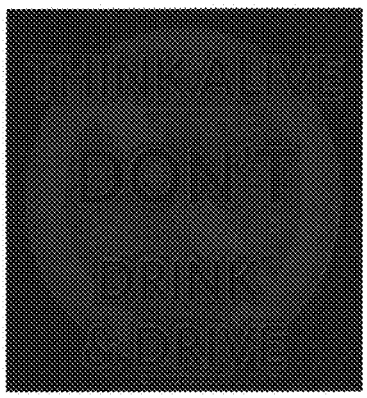

Example #3: Referring to FIG. 6 the diliet artwork with text responds to specific lighting (given the artwork is lit in darkness or low ambient light) in the specific dramatic ways, or "Colour State/s"—CS, wherein colour of the text/drawing/sketch-line(s)/background of the drawing sheet or meaning of the massage therein or any 2 dimensional/3-dimensional effect created in said artwork is improvised using diliet dynamism.

CS #1—Daylight/White Light—Main colours Yellow, Blue, Green, Red, Cyan and Magenta visible, and their shades, patterns and backgrounds therein CS #2—Cyan Light—Background remains Green. Magenta turns Blue. Yellow turns Green. Green remains Green. The Cyan pattern in the centre stands out differently against blue.

CS #3—Magenta Light—The Green background dramatically turns dark and the patterns transforms. Yellow turns Red. Magenta is Magenta . . . and so on.

CS #4—Yellow light—Background back to dark Green. Cyan turns Green. Blue turns black. Magenta turns Red.

CS #5—Red Light—Background turns dark Red. All Green, Blue and Cyan turn Black, while the rest are Red.

CS #6—Blue Light—Background turns dramatic Black. All Green, Red and Yellow turn Black, while the rest are Blue.

The diliet dynamism, as per Example 3 herein and the corresponding FIG. 6, gets even more enhanced when each colour state transitions from one to the other over time—quickly, slowly or immediately—in different orders, each combination leading to a different visual experience.

Figure 7:
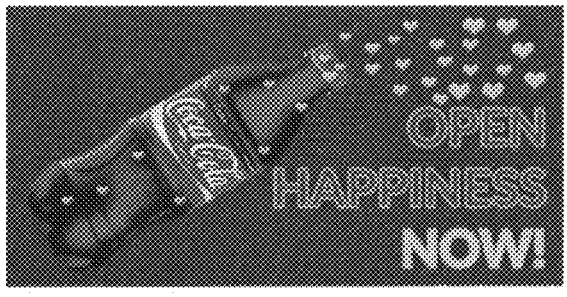
Figure 7:
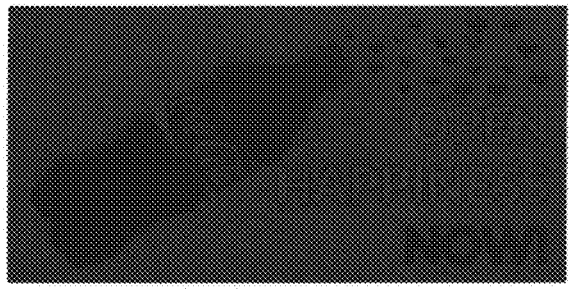
Figure 7:
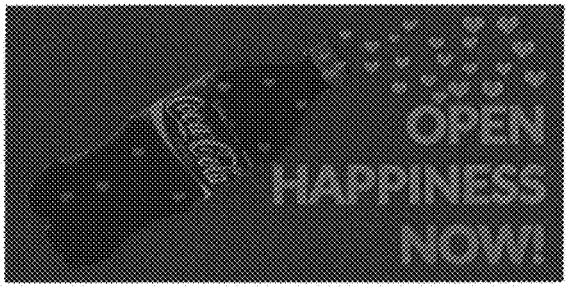
Figure 7:
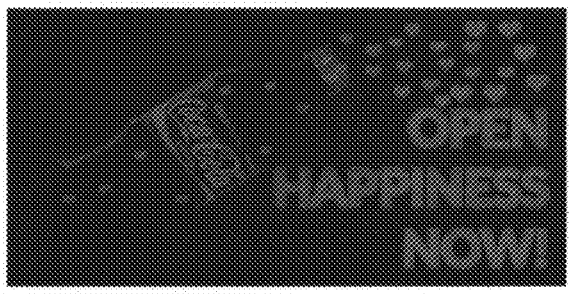
Figure 7:
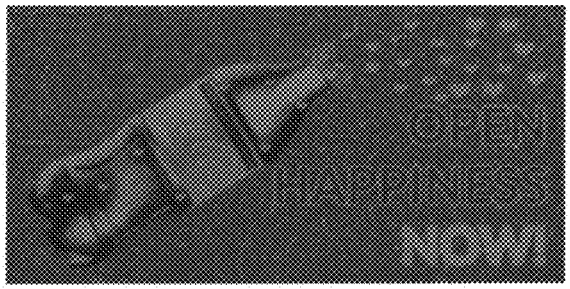
Figure 7:
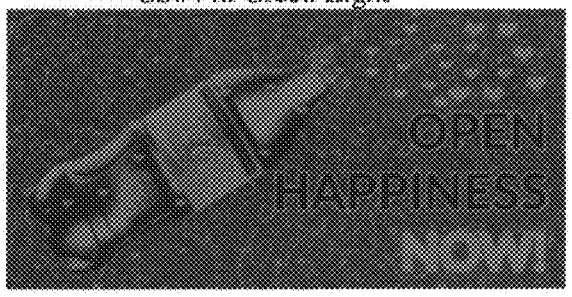
Figure 7:
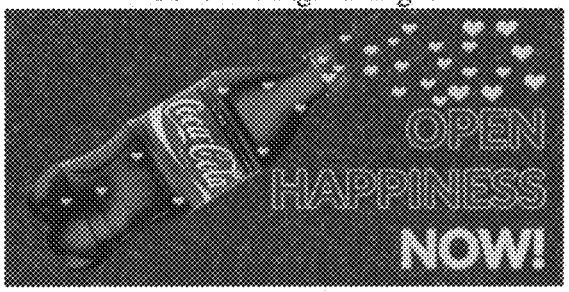

Example #4: Referring to FIG. 7 the proposed diliet outdoor billboard design or wall painting (for illustration purposes only), which looks a specific way in the daylight responds to specific lighting(given the Billboard is lit after sundown in low ambient light) in the specific dramatic ways—CS, wherein colour of the text/drawing/sketch-line(s)/background of the drawing sheet or meaning of the massage therein or any 2 dimensional/3-dimensional effect created in said artwork is improvised using diliet dynamism.

CS #1 in Daylight or White light (R255 G255 B255) Magenta Background. Yellow hearts. White, Cyan and Yellow text. And patterns and text outlines therein CS #2 in Blue(B255) Light—Blue Background. Yellow hearts turn Black. Cyan & White text turns Blue. Yellow text turns Black.

CS #3 in Cyan (G255 B255) Light—Blue Background. Yellow hearts turn Green. Cyan & White text are Cyan. Yellow text turns Green.

CS #4 in Green Light—Background turns dramatic Black. Yellow hearts turn Green. Cyan, Yellow & White text are Green.

CS #5 in Magenta Light—Background back to Magenta. Yellow hearts turn Red. Cyan text is Blue. White text is Magenta. Yellow text is Red.

CS #6 in Red Light—Background turns Red. Yellow hearts turn Red. Cyan text is Black. White text is Red. Yellow text is Red.

CS #7 in Yellow Light—Background turns Red. Yellow hearts stay Yellow. Cyan text is Green. White text is Yellow. Yellow text is Yellow.

The diliet dynamism, as per Example 4 herein and the corresponding FIG. 7, gets even more enhanced and spectacular when each colour state transitions from one to the other over time—quickly, slowly or immediately—in different orders, each combination leading to a different diliet visual experience.

ALL diliet artworks can be made into back-lit translides (translucent artworks that glow when back-lit), with the same dramatic diliet dynamism.

Example #5: this diliet design proposed for a bridge, referring the FIG. 8, illustrates the direct and collaborative application of diliet in an unusual way. The purpose of this application of diliet, is to demonstrate how the colour of the bridge lit by a diliet lighting sequence; albeit after sunset, when the ambient light is low; can be used as a visual indicator of the traffic flow, as indicated by the colour of the bridge. Green—free flowing. Yellow—medium flow. Orange—Slow flow. Red—crawling.

Say we take a normal white bridge, represented in the schematic presentation of FIG. 8(*a*).

Then paint it with colours using specific calibrated diliet colours, which now looks, presented schematically in FIG. 8(*b*), like this in the daylight. Please note the big Arrows added to the bridge design in FIG. 8(*b*). These indicate the direction of traffic flow on the Bridge. For us in India, the traffic on the side of the bridge towards us, will be moving from left to right, and on the far side, from right to left. These arrows will be lit individually, to control the specific diliet colour state, as and when required.

The entire bridge will be lit by diliet lighting. At night, lit with White light it will look like as presented schematically in FIG. 8(*c*).

The dramatic Colour State of the bridge will indicate the following information about traffic, and will smoothly transform from one CS to the another, depending on the Traffic density.

Traffic Crawling on both sides—Red & both Arrows Red, as schematically represented in FIG. 9(*a*).

Traffic Slow on both sides—Orange & both Arrows Orange, as schematically represented in FIG. 9(*b*).

Traffic Medium on both sides—Yellow & both Arrows Yellow, as schematically represented in FIG. 9(*c*).

Traffic Free on both sides—Green & both Arrows Green, as schematically represented in FIG. 9(*d*).

Now because the Arrows are lit separately (and masked, so that the light does not spill onto other spaces) we can also use the bridge to indicate travel information like the following. Traffic Crawling on this side, but Medium on the other side, as schematically represented in FIG. 9(*e*). In this case, the colours on the opposite side of the Bridge will be Yellow, with the two top Arrows in Red, to convey for viewers from the other side of the Bridge, that the Traffic was Medium on their side, and Crawling on the other side.

Traffic Free on this side, but Crawling on the other side, as schematically represented in FIG. 9(*f*). In this case, the colours on the opposite side of the Bridge will be Red, with the two top Arrows in Green, to convey for viewers from the other side of the Bridge, that the Traffic was Crawling on their side, and Free on the other side.

The diliet lighting sequence controller will be configured; with the appropriate technology to receive traffic update data (say through Google Maps) or use direct data extractable from cameras on the Bridge; to change colours depending upon the information received, thus changing the Colour State of the Bridge etc.

Example #6: As shown in FIG. 10, is a diliet artwork crafted for an exhibition on issues of "sustainable development" at the India Habitat Centre, New Delhi. The artwork landmarks 109 years of plastic, and that almost every bit of the 250 trillion kilos produced since, still exists. This specific artwork demonstrates the way diliet techniques of creating forms and shapes in specific calibrated colours, enable a tangible animated movement within the still diliet Artwork.

CS #1—White light—shows three Red and Yellow shaded Dumpster Trucks at the bottom, rows of Magenta and Cyan plastic bottle outlines in alternating rows, and an outline of India reflected in the background. Please note that the Trucks have been crafted in a certain way with their Dump containers in several specific colours and shades, both pushed up and flat.

CS #2—Blue Light—Everything turns blue or black and the whole image darkens, and objects and text disappear or merge into the background.

CS #3—Green Light—The background glows Black and Dark Green with the outline barely visible, and objects and text appear in Green, three rows of Green bottles, and three Dumpster Trucks in Green with their Dump Container clearly pushed up, with their stripes visible in shades of Green.

CS #4—Red Light—Everything turns Red or Black and the background remains dark, and objects and text appear in Red, three rows of Red bottles at heights higher than the Green bottles(simulating movement) and three Dumpster Trucks now in Red with their Dump Container now flat (simulating movement) with their stripes visible in shades of Red.

In an enclosed light controlled environment, the viewer will never see CS #1. Instead CS #3 and 4 will be in an ongoing loop; say every 2 seconds the CS dissolves from one to the other over one second, and after every 30 seconds dissolves to CS #2 to rest, before starting again in 4 seconds. Thus the artwork will make it seem that the bottles are moving up by layers, as the dumpster Trucks push their dump container up and down, and then rest in CS #2.

diliet thus can be applied in many diverse dramatic ways to transform Colour States, perception of forms and enable animation, in specially designed/coloured 2-D and 3-D objects, ranging from Artworks & Billboards to Sculptures, Buildings, Bridges, Vehicles, Room Interiors, Subways and Costumes/Sets in the Performance Arts.

Figure 11:
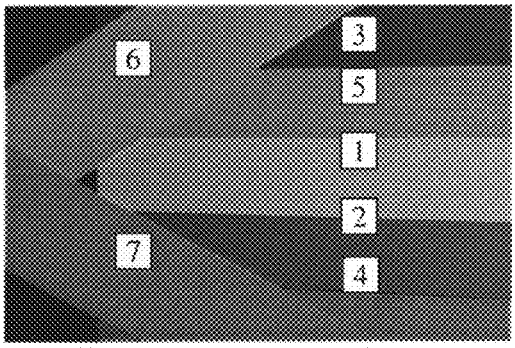
Figure 11:
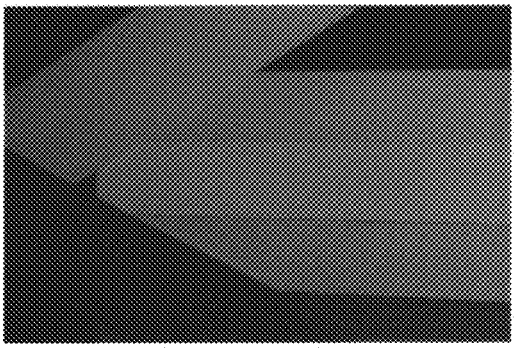
Figure 11:
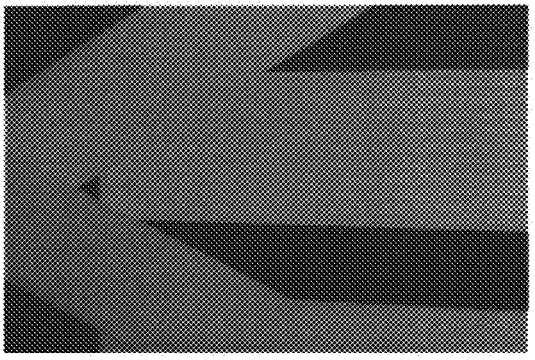
Figure 11:
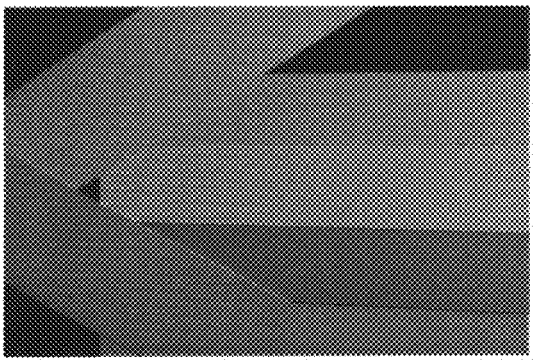
Figure 11:
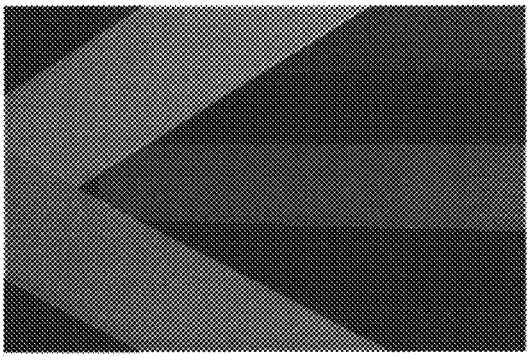

Example #7: Referring to FIG. 11, current diliet technique presents unique luminescence in specific colours when lit by specific light, without using any ultra violet light or fluorescent colours. However, the effect of specific diliet colour lighting on specific fluorescent colours, not only presents an increased brightness with certain light colour (as it's expected to), but also makes the colours(or objects, signs, components, etc. painted in specific fluorescent colours) dynamic, and they transform colours similar to diliet artworks do, in specific lighting sequences. This enables a whole range of applications from futuristic dynamic airport/helipad runway markings to diverse signage and future art and architecture.

For example, in FIG. 11 (actual photographs of coloured strips), the effect and brightness of diliet lighting sequences is presented and measured using 1—White, 2—Red, 3—Green, 4—Blue, 5—Yellow, 6—Fluorescent Yellow and 7—Fluorescent Green strips FIG. 11*a*—The Strips in White Light (number coded by colour)

FIG. 11*b*—The Strips in Red Light—Blue, Green and Fluorescent Green have turned dark, rest look Red FIG. 11*c*—The Strips in Green Light—Blue & Red have turned dark, the rest look Green FIG. 11.*d*—The Strips in Yellow Light—Blue has turned dark. White, Yellow and Fluorescent Yellow look Yellow. Red, Green and Fluorescent Green do not change colour FIG. 11.*e*—The Strips in Blue Light—Red, Yellow and Green have turned dark, and the Fluorescent Green and Fluorescent Yellow are bright and do not change colour. White and Blue look Blue.

TABLE 4

Compares the diliet colour transformation of White, Yellow and Fluorescent Yellow in different diliet light colours, against a Charcoal Black Background.

| Light\Strip | Background | White | Yellow | Fl.Yellow |
|---|---|---|---|---|
| W | Charcoal | W | Y | Y |
| R | Charcoal | R | R | R |
| G | Charcoal | G | G | G |
| B | Charcoal | B | V dark | Y |
| Y | Charcoal | Y | Y | Y |

Figure 12:
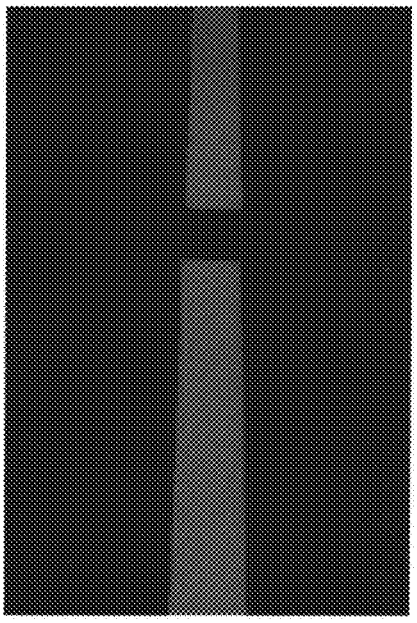
Figure 12:
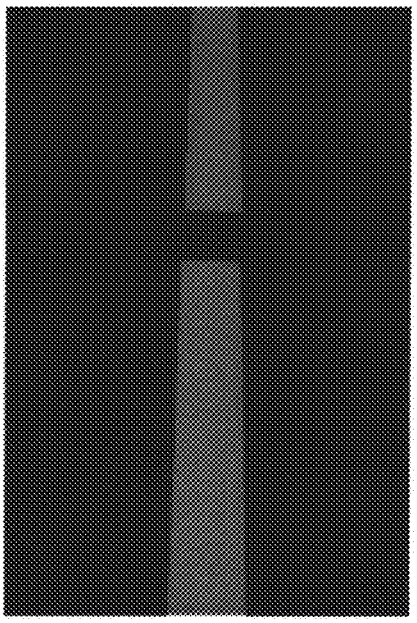
Figure 12:
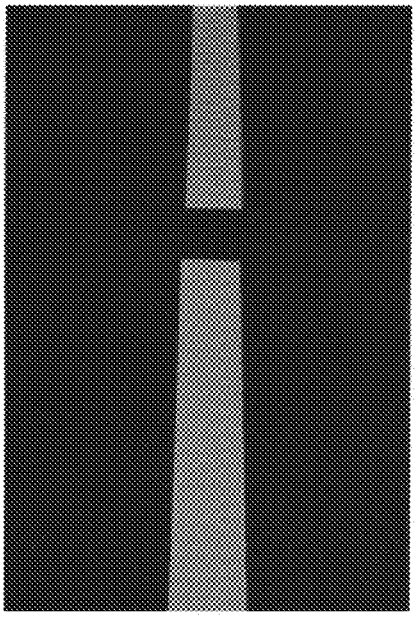

FIG. 12 shows the effect of diliet colour lights on the Yellow Fluorescent strip against the Charcoal Black Background.

FIG. 12.*a*—in Red light

FIG. 12.*b*—in Green Light

FIG. 12.*c*—in White/Blue Light

The Brightness (of reflected light) of the coloured strips was measured in relation to the Brightness of the Charcoal Black colour background the strips were kept against; to simulate a runway; using a Canon 60D TTL light meter. The Fluorescent Yellow strip in just Blue light was relatively much brighter than any of the strips in full white light. The following table compares the brightness and luminosity of White, Yellow and Fluorescent Yellow in different diliet light colours in comparison to the brightness of the background. Luminosity=Brightness of Strip−Brightness of Background

TABLE 5

Brightness and Luminosity calculated in foot candles

| Light\Strip | Brightness Background | Brightness White | Brightness Yellow | Brightness Fl.Yellow | Luminosity White | Luminosity Yellow | Luminosity Fl.Yellow |
|---|---|---|---|---|---|---|---|
| W | 26.13 | 392.00 | 313.60 | 470.40 | X-365.87 | 287.47 | Y-444.27 |
| R | 9.80 | 203.84 | 156.80 | 156.80 | 194.04 | 147.00 | 147.00 |
| G | 26.13 | 392.00 | 313.60 | 313.60 | 365.87 | 287.47 | 287.47 |
| B | 12.06 | 235.20 | 31.36 | 627.20 | 223.14 | 19.30 | Z-615.14 |
| Y | 26.13 | 392.00 | 313.60 | 392.00 | 365.87 | 287.47 | 365.87 |

The Luminosity (Difference between Background and strip) of the Yellow Fluorescent strip was 21.43% more luminous in full white light, than the White strip in full white light((Y−X)/X). The Yellow Fluorescent strip was 38.46% more luminous just blue light, than in full white light ((Z−Y)/Y). The Yellow Fluorescent strip in just Blue Light was 68.13% more luminous than the White strip in full white light, thus using $\frac{1}{3}^{rd}$ the light consumption for 68.13% more luminosity. ((Z−X)/X).

This diliet insight has diverse dynamic applications in creating futuristic & aesthetic dynamic runway/signage/numbering/identification or communication markings (alongside runway & signage markings on aircraft carriers; Vehicle, ship & aircraft markings; diverse Signage; Buildings; etc), that have much higher visibility than the standard white or coloured markings, and can change colour from Yellow, to Red, to Green(and several other diliet shades in-between), depending on the communication required from the colour state. Alongside, depending on the visibility required, the brightness of the lighting can be increased or decreased automatically, using visibility sensors connected to the DMX controllers of the LED lights. The brightness can be further enhanced at very low cost by using additional dmx controlled blue LED diodes, and special proprietary reflectors, that further enhance the brightness of its light, and thus present a further bright Fluorescent Yellow in a brighter and fully controllable manner.

Figure 13:
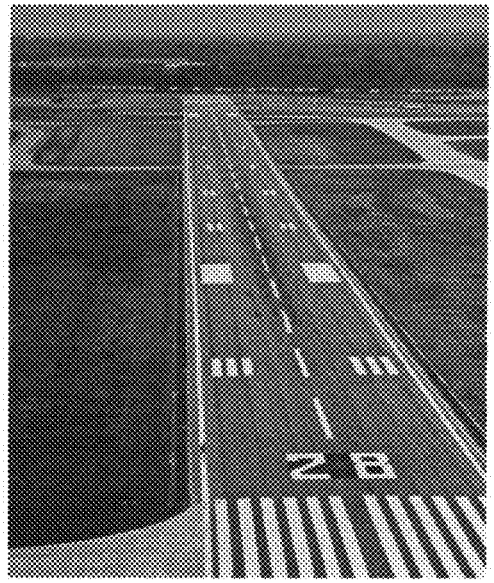
Figure 13:
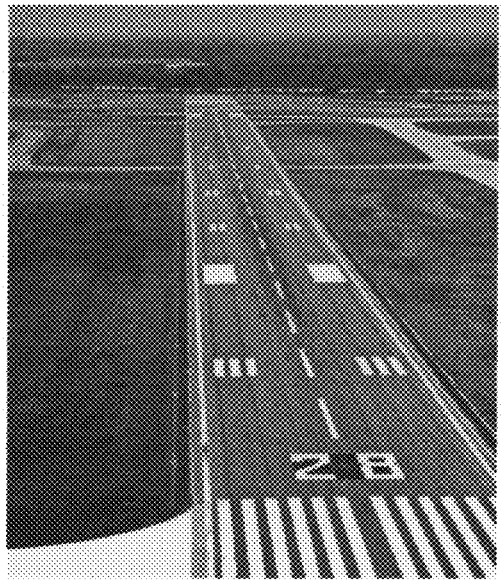
Figure 13:
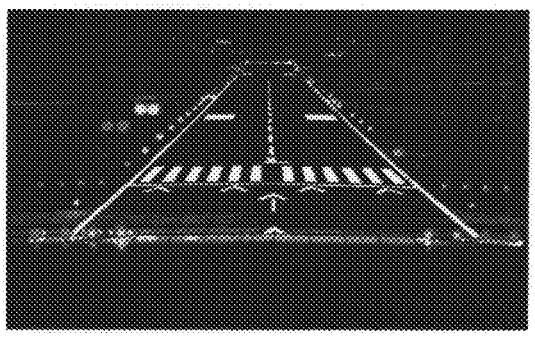
Figure 13:
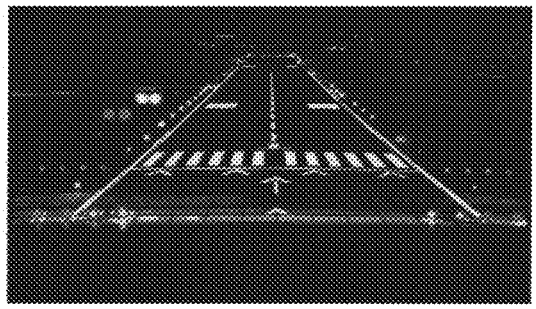
Figure 13:
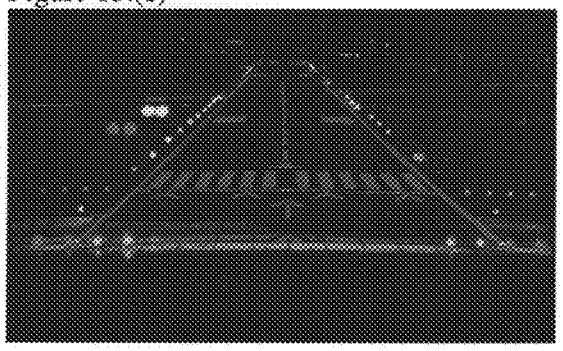
Figure 13:
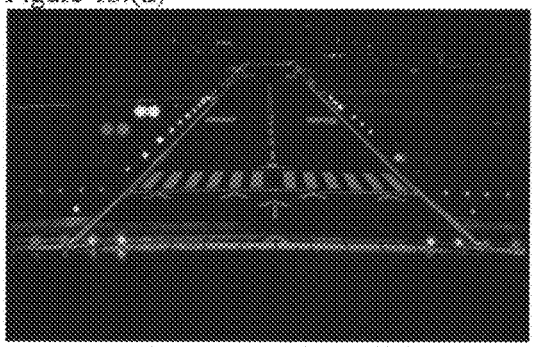

For example, FIG. 13.*a* is a normal runway with standard white markings in the day FIG. 13.*b* is the same runway with diliet Fluorescent Yellow markings, in the day, looking far more aesthetic that the white markings.

FIG. 13.*c* shows a normal runway, with standard white markings, lit up at night.

FIG. 13.*d* shows the same runway with diliet Fluorescent Yellow markings, lit up with Blue Light in the night, looking far more aesthetic and brighter that the white markings. The Fluorescent Yellow markings are 38.46% brighter than White markings in white light. If the runway is lit by Blue light (say in times of low visibility) then the markings will shine at 68.13% enhanced brightness compared to White markings in White light. The blue light can be linked to a visibility sensor and then automated to become brighter to make the markings even brighter, or vice versa, depending on what is required and appropriate for the visibility of the markings.

FIG. 13.*e* shows the diliet runway in Green light, transforming the runway markings to Green FIG. 13.*f* shows the diliet runway in Red light, transforming the runway markings to Red. The combination of diliet colours and lighting sequences, offer a new application to create such dynamic coloured runways, markings, signages, etc. which transform colours when needed, and become automatically brighter when in times of low visibility. Of course, the markings will need to follow the runway colour codes, as determined by relevant authorities. However, the use of diliet technology for runways, will not only present a futuristic aesthetic of bright colours, it will enable a controllable and automatable mechanism which responds to times of low visibility, by making the shine more brighter than they do currently.

Example #8: By using the diliet technique namely, diliet Colour Randomiser of colour and coloured lighting, numbers (and indeed letters of all languages, diverse symbols, etc.) can be made to appear and disappear when lit with specific coloured light. This opens up many creative applications in games of chance and funding, of making options appear and disappear in calculatable probabilities, using a random selection of coloured lighting.

For example, using 99 numbers—1 to 99, a board is created.

Numbers Coloured Red, Green and Blue—17 each,

Numbers coloured Yellow, Cyan and Magenta—16 each,

On a Black background, with the numbers separated by a white Grid as depicted in FIGS. 15*a*-15*g*.

Said diliet Colour Randomiser has many applications, using Numbers and Alphabets of all languages as well as diverse symbols and shapes (together call "Shapes") in different diliet calibrated colours, which appear and disappear when lit by specific coloured lights. The probability of the valid appearance of these shapes can be further influenced and complexified by different coloured outlines on each shape and different colour backgrounds for the shapes. In exemplary case, in FIGS. 15*a*-15*g*, each number can have 1,2,3 or more outlines of different diliet colours, the specific combination of which will be pre-designated, and then arrived at only with a specific diliet light.

For Example, #9: Referring to FIG. 14, numbers, 55, 67 and 89 each number has two colour outlines, and a background colour. If the winning combination of colours is specified; say Red and Blue; then the combinations possible using diliet calibrated colours and lights become more complex. This winning combination can be played out with say 2 dice; or with circular spinning dials, or lottery-type draws, etc; each number corresponding to a different colour light of six colours—R, G, B, Y, C & M. The winning combination will be 2 coloured lights, which make certain colours appear or disappear for each Number slot.

For example, with R&B light

- in 67 the Y background will turn R, and the rest will remain the same (this can be a special precious case!)
- in 55 the G background will turn dark, $1^{st}$ outline Y will turn R, $2^{nd}$ outline will stay R and the number will turn from C to B
- in 89 back ground remains R, the $1^{st}$ outline remains B, the $2^{nd}$ outline also turns B (another special case) and the number turns from Y to R etc.

Different combinations can be deemed special or not, thus complexifying the probabilities and the calculations. The diliet Ramdomising process can be combined with various prevalent processes of chance gaming, quizzing, casinos, etc.

The Randomising process can also be done by using specifically coloured diliet Cards, with single, dual or triple colours; say 10 each of 6 kinds; which are then distributed to players, who place them on Numbers on a board, or some such indication grid. A final colour can be chosen by a throw of dice. Then the coloured diliet lights light up in a random (or not) sequence. The light that it ends on, will determine which cards are glowing with the correct/decided colour. This application can be designed in circular or oval shapes, or indeed in a diverse number of forms and colours, divided up into regions, with different Shape.

For example, a Circular Board is mounted vertically on a system that will allow it to rotate, with Numbers/Symbols in different diliet colour zones. Several lights of different colours are focused on the diliet colour zones on the Circular Board. Users choose different numbers. A designated final colour is chosen. Now this board is rotated/spun, till it stops. The zones that light up in the designated colour is shortlisted.

Diliet Desaturating Colour Combinations:

Colours with no common colour components. eg. R&G, R&B, B&G, Y&B, M&G, C&R

When Light & artwork colours combine in these combinations the colour of the artwork Desaturates (loses colour information and turns black or dark grey) since that particular artwork component colour does not have the colour information present in light in the colour, to reflect back. Thus, that colour turns dark dramatically, and can merge into a suitable background colour around it.

TABLE 7 diliet desaturating colour combinations

| Artwork Colour | Light Colour | effect on Artwork Colour |
|---|---|---|
| R255-1 | G255-1 | Destaurates (black or dark grey) |
| G255-1 | R255-1 | Destaurates (black or dark grey) |
| B255-1 | R255-1 | Destaurates (black or dark grey) |
| B255-1 | G255-1 | Destaurates (black or dark grey) |
| B255-1 | Y255-1 | Destaurates (black or dark grey) |
| Y255-1 | B255-1 | Destaurates (black or dark grey) |
| R255-1 | C255-1 | Destaurates (black or dark grey) |
| C255-1 | R255-1 | Destaurates (black or dark grey) |
| G255-1 | M255-1 | Destaurates (black or dark grey) |
| M255-1 | G255-1 | Destaurates (black or dark grey) |

diliet transforming colours combinations—colours with common colour components. eg. R&Y, R&M, B&M, B&C, G&Y, G&C, W&R, G or B When Light & artwork colours combine in these combinations the colour of the artwork transforms (changes colour information and turns into the colour of the light) the colour transforms dramatically, and can merge into a suitable background colour around it.

TABLE 8 diliet transforming colours combinations

| Artwork(AW) Colour | Light Colour | effect on Artwork Colour |
|---|---|---|
| Y (G255-1 + R255-1) (Yellow Group)* | G255-1 | turns Green (to the saturation of Green in the artwork or the light, whichever is lower. ie. AW colour is G200 + R200, lit by light G150, will turn G150) |
| Y (G255-1 + R255-1) (Yellow Group)* | R255-1 | turns Red (to the saturation of Red in the artwork or the light, whichever is lower. ie. AW colour is G200 + R200, lit by light R150, will turn R150) |
| C (G255-1 + B255-1) (Cyan Group)* | B255-1 | turns Blue (to the saturation of Blue in the artwork or the light, whichever is lower. ie. AW colour is G200 + B200, lit by light B150, will turn B150) |
| C (G255-1 + B255-1) (Cyan Group)* | G255-1 | turns Green (to the saturation of Green in the artwork or the light, whichever is lower. ie. AW colour is G200 + R200, lit by light G150, will turn G150) |
| M (R255-1 + B255-1) (Magenta Group)* | R255-1 | turns Red (to the saturation of Red in the artwork or the light, whichever is lower. ie. AW colour is G200 + R200, lit by light R150, will turn R150) |
| M (R255-1 + B255-1) (Magenta Group)* | B255-1 | turns Blue (to the saturation of Blue in the artwork or the light, whichever is lower. ie. AW colour is G200 + B200, lit by light B150, will turn B150) |
| White to Black-1: R255 + G255 + B255 to R1 + G1 + B1(255 shades without Black) | Any diliet Colour Light | Turns into the colour of the light (to the White in the artwork or the colour saturation of the light, whichever is lower. ie. AW colour is R200 + G200 + B200, lit by light B150, will turn B150) |

*All possible combinations of the 256 shades of the 2 Primary colours in the Group (reference for convenient Grouping only) Point to be noted about an artwork component coloured in any of the 3 Groups being lit by colours from the same Group: The Artwork will transform to the saturation of the combination of the two sets of colour calibrations (artwork & light) using the lowest two calibrations from either artwork or light. So if an Artwork Component is coloured in R201 + B35, and lit by a light coloured R35 and B201, the artwork will transform to the colour-R35 + B35, taking the two lowest calibrations from each colour.

diliet non-transforming colours combinations—same colours. eg. R&R, G&G, B&B, M&M, C&C, Y&Y, W&W, or W light on any diliet colour.

FIG. 16: When Light & artwork colours are the same colour, the colour of the artwork does not change colour.

diliet artworks and objects use less than 0.8% of RGB colours as the main colours, shades and tones to be used in combinations, shapes and forms(components) to achieve the diliet dynamic effect, when lit by a specific sequence of coloured RGB light. Hardly any non-diliet colours are used, and if so at all in only a secondary or incidental way. Besides, the colours and content of the components are especially created to respond predictably to specific coloured lights and transitions between light colours. This prescription of the diliet technique, principle and process, makes it unique and inventive. Most visual artworks, photographs or objects contain colours that have tones and shades with all three Primary colours (~90% of all RBG colours). And where the rest of the 1% colours may be present, they have not been used an intentional presence, meant to respond to and transform in the presence of specific coloured lighting sequences. So, artworks not created using the diliet technique will typically turn shades of the light colour used to light it. And even if there is a presence of some diliet colours and shades, the main colours and forms of the components, are not especially & intentionally crafted, coloured, combined and juxtaposed, to respond dramatically, dynamically and predictably to specific coloured lighting and transitions between coloured lights.

In diliet Artworks & objects the main colours are diliet colours, and the components are especially & intentionally crafted, coloured combined and juxtaposed, to respond dramatically, dynamically and predictably to specific coloured lighting and transitions between coloured lights. The diliet Artwork is imbued; and indeed, this is the test of a unique diliet Artwork; with such specific components that have embedded in them specific calibrated colours and shades (diliet colours). The Artworks are static, and look quite striking in the daylight, or lit up with White light. When in a dark space the static artwork is lit by a specific diliet lighting sequence, the components start transforming dramatically, since the diliet colour combinations in the Components appear, disappear or change colour helplessly; but predictably as crafted & intended; in response to the light colour, and are completely controlled, choreographed & enslaved by the diliet lighting sequence. We want to claim rights to this unique & specific combination of different media, which results in a dilietfull performance collaboration of the Artwork and Lighting. As if the diliet Artwork is an Orchestra with a specific instruments and a specific music score, which responds and performs dramatically & predictably to the influence, signals and commands as conducted by the Lighting. So, the Light fully controls the dynamic perceptual state of the static artwork, as its light colour changes in different sequences and transitions, and transforms the perceptual state of the artwork.

Although the invention has been described with reference to specific embodiments, this description is not meant to be construed in a limiting sense. Various modifications of the disclosed embodiments, as well as alternate embodiments of the invention, will become apparent to persons skilled in the art upon reference to the description of the invention. It is therefore contemplated that such modifications can be made without departing from the spirit or scope of the present invention as defined.

I claim:

1. A method for creating and designing a static artwork that is two-dimensional (2D) or three dimensional (3D) configured to turn into a dynamic artwork in response to a lighting sequence comprising:

creating the static artwork that is coloured using RGB colouring having colours' gradient of each of primary colours red, green, and blue, and secondary colours yellow, magenta, and cyan between fully saturated colours and their shades; and, exposing said static artwork to said lighting sequence so as to form a transformation of said colours of said static artwork, creating a simulated movement of conversion of said artwork from static artwork to dynamic artwork wherein the creating of said static artwork includes the steps of:

analyzing the RGB colours:

selecting materials, paints, and coloured components having colours' gradient of each of primary colours red, greed, and blue, and secondary, colours yellow, magenta, and cyan between fully saturated colours and their shades;

creating static art artwork; and performing a colour analysis check of accuracy of colours in the static artwork compared to colours selected for creating of the static artwork.

2. The method according to claim 1, wherein said static artwork includes at least one of images, elements, text, shapes and backgrounds consisting of graphics, forms, shapes, texts, illustrations, and objects.

3. The method according to claim 1, wherein said two-dimensional (2D) or three dimensional (3D) static artworks are created using fluorescent inks, paints, materials and coatings mixed with non-fluorescent inks, paints, materials and coatings, in the following steps:

a. said fluorescent colours or coatings in said two-dimensional (2D) or three dimensional (3D) static artworks, exhibit enhanced luminosity compared to exhibited by non-fluorescent colours or materials, when lit by calibrated RGB light colours, without the use of ultra violet and infra-red light b. said calibrated similar fluorescent and non-fluorescent colours in said 2D and 3D static artworks exhibit distinctly different colour transformations in responses to said calibrated RGB light colours, without the use of ultra violet and infra-red light.

4. The method according to claim 1, wherein said RGB colouring is used in elements and backgrounds of said two-dimensional (2D) or three dimensional (3D) static artworks; calibrated values of one or two colours of the RGB calibration values (R, G and B) of a colour is similar to the RGB calibration values of a different colour, the colours will merge into each other by transforming into similar colours when lit up with a calibrated RGB colour light having same RGB values with said different colours of the artwork, leading to additional colour states and produce additional points of transitions between the colour of the lights.

* * * * *